United States Patent [19]

Wu

[11] Patent Number: 4,972,056

[45] Date of Patent: Nov. 20, 1990

[54] KEYSWITCH

[76] Inventor: I-Long Wu, No. 85-1, 2F, Ning Han St., Shin-Tun Dist., Taichung, Taiwan

[21] Appl. No.: 358,664

[22] Filed: May 30, 1989

Related U.S. Application Data

[63] Continuation-in-part of Ser. No. 227,310, Aug. 1, 1988, abandoned.

[51] Int. Cl.[5] ..... H01H 1/06; H01H 13/07

[52] U.S. Cl. ..... 200/276.1

[58] Field of Search ..... 200/5 R, 5 A, 16 A, 200/61.76, 276.1, 27 C, 341-345

[56] References Cited

U.S. PATENT DOCUMENTS

| | | | |
|---|---|---|---|
| 3,735,058 | 5/1973 | Berry | 200/16 A |
| 3,842,230 | 10/1974 | Kashio et al. | 200/5 A X |
| 3,924,089 | 12/1975 | Abernethy | 200/276.1 X |
| 3,928,736 | 12/1975 | Drage | 200/5 A |
| 4,733,036 | 3/1988 | Koizumi et al. | 200/276.1 X |

FOREIGN PATENT DOCUMENTS

| | | | |
|---|---|---|---|
| 860162 | 8/1981 | U.S.S.R. | 200/276.1 |

*Primary Examiner*—J. R. Scott

*Attorney, Agent, or Firm*—Harness, Dickey & Pierce

[57] ABSTRACT

A keyswitch includes a hollow base, a cover sealing the open top side of the base, a push-button type actuator guided to move up and down, two spaced-apart electrode elements fixed on the bottom wall of the base, and a coil spring disposed within the base between the electrode elements and the actuator. The base, cover and actuator are made of an insulative material, while the electrode elements and the coil spring are made of a conductive material. The structures of the base, spring, actuator and cover are symmetrical so as to be easily joined together. The spring is shaped in the form of a truncated cone and has turns of different diameters which gradually decrease in size from the bottom to the top thereof. The lowermost turned portion of the spring is insulated from the electrode elements. When the actuator is depressed, one turned upper portion of the spring moves through the lowermost turned portion of the same so as to come into bridging contact with the electrode elements and establish a conductive path between the electrode elements.

7 Claims, 6 Drawing Sheets

KEYSWITCH

CROSS-REFERENCE OF RELATED APPLICATION

This invention is a continuation-in-part of Application Serial No. 07/227,310 filed on Aug. 1, 1988. (now abandoned)

BACKGROUND OF THE INVENTION

This invention relates to a push-button type switch, more particularly to a keyswitch utilized on a keyboard.

A metallic reed is usually used in a conventional keyswitch and serves as an operable contact so as to achieve the control of such a keyswitch. The construction of a conventional keyswitch is overly complex and therefore difficult to manufacture. Due to the difficulty of the manufacturing process, many poorquality or defective products are produced which must be discarded in order to maintain proper quality control, thereby causing waste and raising manufacturing costs.

SUMMARY OF THE INVENTION

An object of this invention is therefore to provide an inexpensive keyswitch of a symmetrical structure which can be easily manufactured.

Another object of this invention is to provide a keyswitch which effects electrical connection and disconnection of two electrodes by the compression and elastic repulsion of a coil spring whose turned portions have different diameters.

According to this invention, a keyswitch includes a hollow base, a cover sealing the open top side of the base, a push-button type actuator guided to move up and down, two spaced-apart electrode elements fixed on the bottom wall of the base, and a coil spring disposed within the base between the electrode elements and the actuator. The base, cover and actuator are made of insulative material, while the electrode elements and the coil spring are made of conductive material. The structures of the base, spring, actuator and cover are symmetrical so that they may be easily joined together. The spring is shaped in the form of a truncated cone and is comprised of turns of different diameters which gradually decrease in size from the bottom to the top thereof. The lowermost turned portion of the spring is insulated from the electrode elements. When the actuator is depressed, one turned upper portion of the spring moves through the lowermost turned portion of the same so as to come into bridging contact with the electrode elements and establish a conductive path between the electrode elements.

BRIEF DESCRIPTION OF THE DRAWINGS

Other features and advantages of this invention will become apparent in the following detailed description of the preferred embodiments of this invention, with reference to the accompanying drawings, in which.

Figure 7:
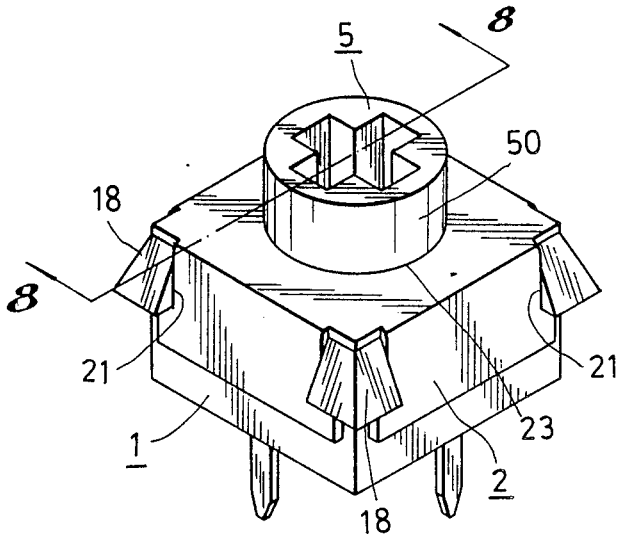
FIG. 7 is a perspective view showing the keyswitch of this invention.
Figure 8:
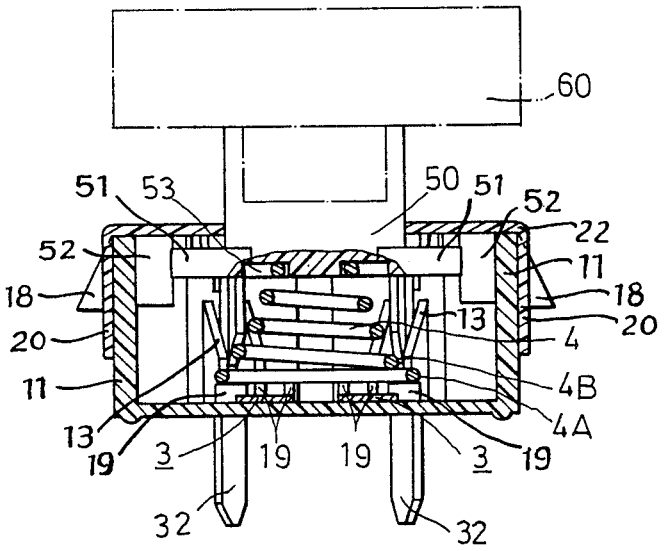
Figure 8A:
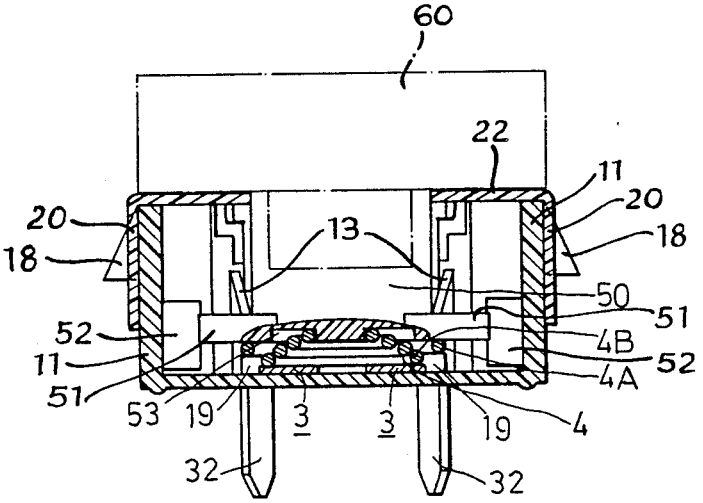
Figure 9:
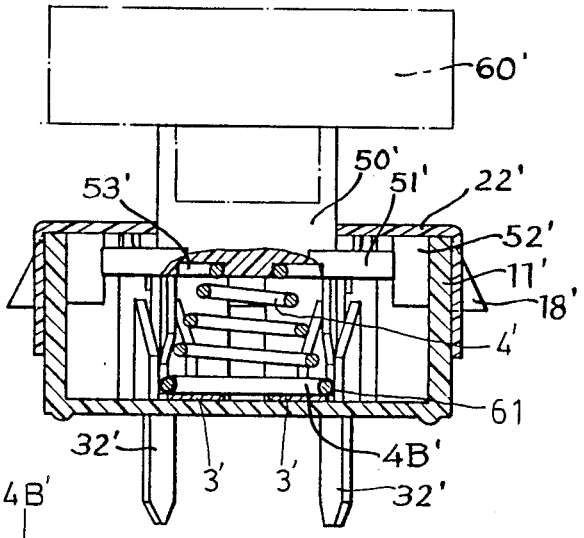
Figure 9A:
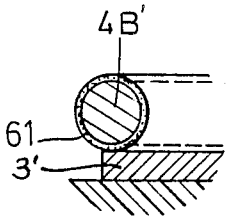
Figure 10:
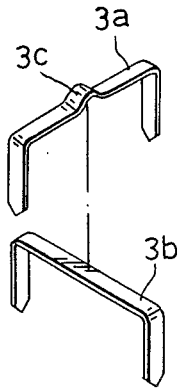
Figure 11:
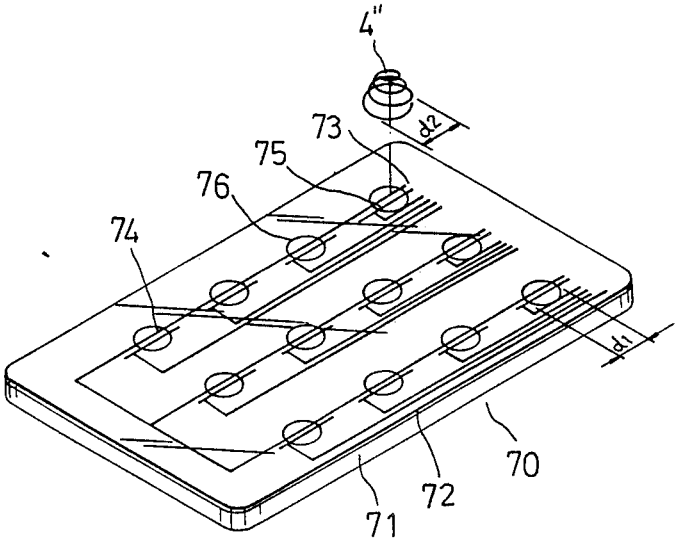

FIG. is a sectional view taken along Line 8—8 in FIG. 7;

FIG. 8A is a schematic view illustrating the operation of the keyswitch;

FIGS. 9 and 9A illustrate another embodiment of the keyswitch according to this invention;

FIG. 10/ illustrates a modified form of the electrode elements of the keyswitch according to this invention; and FIG. 11 is a schematic view illustrating how to utilize the keyswitch on a printed circuit in accordance with this invention.

DETAILED DESCRIPTION OF THE PREFERRED EMBODIMENTS

Figure 1:
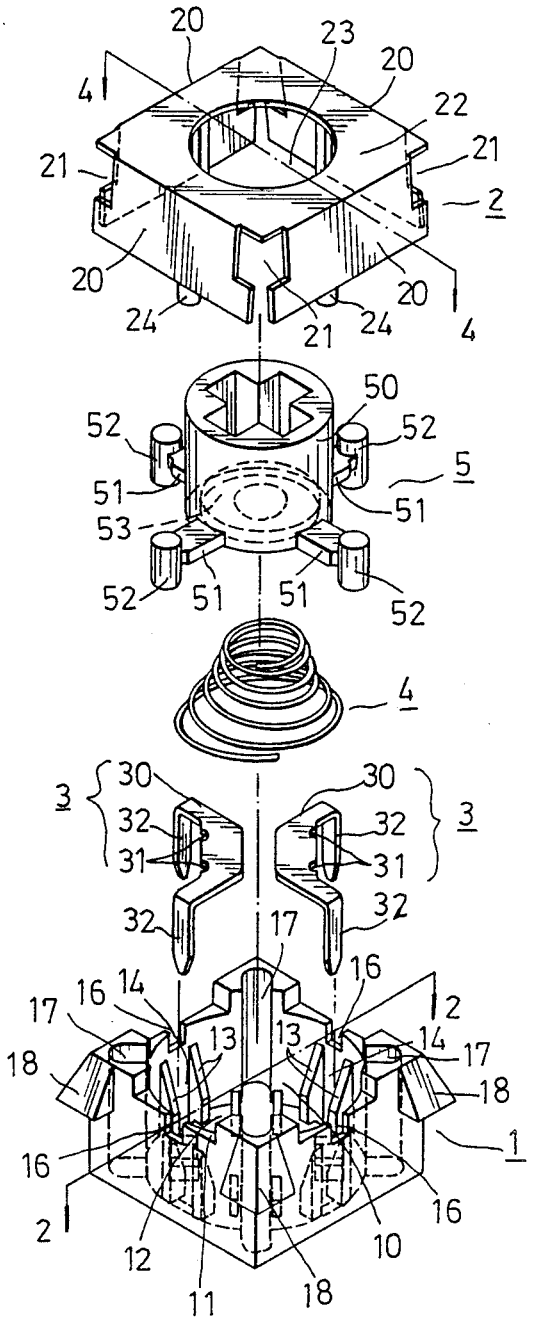
FIG. 1 is an exploded view of a keyswitch according to this invention.
Figure 2:
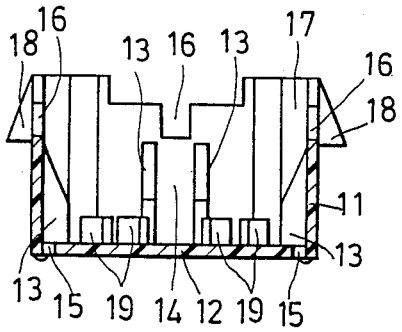
FIG. 2 is a sectional view taken along Line 2—2 in FIG. 1.

Referring to FIG. 1, a keyswitch of this invention includes a hollow insulative base 1, an insulative cover 2, two electrode elements 3, a coil spring 4 and a push-button type actuator 5.

The base 1 has an open top side 10, four interconnected side walls 11 and a square bottom wall 12. Each of the side walls 11 includes two vertical ribs 13 extending from the inner surface thereof so as to define a guideway 14 therebetween, and a notch 16 formed in the upper end portion of the side wall 11 in alignment with the guideway 14. The bottom wall 12 has four holes 15 formed therethrough in alignment with the guideways 14.

Figure 3:
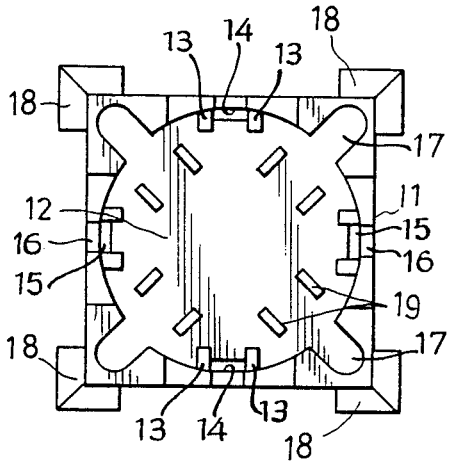
FIG. 3 is a top view showing the base of the keyswitch according to this invention.

Four vertical guide slots 17 are formed in four corners of the inner surfaces of the side walls 11. Four protrusions 18 are provided on four corners of the outer surfaces of the side walls 11. As shown in FIG. 3, the bottom wall 12 includes four pairs of horizontal ribs 19 in alignment with the guide slots 17.

Figure 4:
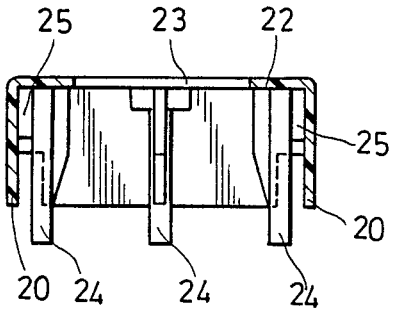
FIG. 4 is a sectional view taken along Line 4—4 in FIG. 1.
Figure 5:
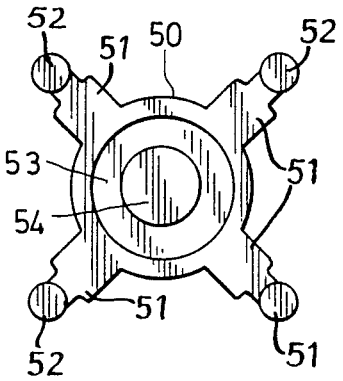
FIG. 5 is a bottom view showing the actuator of the keyswitch according to this invention.

The cover 2 has a square top wall 22 with a central passage 23. Four inverted T-shaped side walls 20 extend separately downward from the periphery of the top wall 22. Any pair of adjacent side walls 20 define an engagement hole 21 therebetween. As shown in FIG. 4, four suspending rods 24 extending downward from four side portions of the top wall 22 to a level below the lower ends of the side walls 20. Four positioning sheets 25 interconnect the suspending rods 24 and the side walls 20 and have lower ends above those of the side walls 20.

Each of the electrode elements 3 has a horizontal body 30 and two legs 32. The horizontal body 30 has two small notches 31.

The spring 4 is shaped in the form of a truncated cone and has a plurality of turned portions of different diameters which gradually decrease in size from the bottom to the top thereof.

The actuator 5 has a cylindrical body 50 with four equidistant connecting rods 51 extending radially and outwardly from the peripheral surface of the body 50. Each of the connecting rods 51 carries a block 52 on the outer end thereof. The body 50 has an annular groove 53 formed in the bottom surface thereof.

Figure 6:
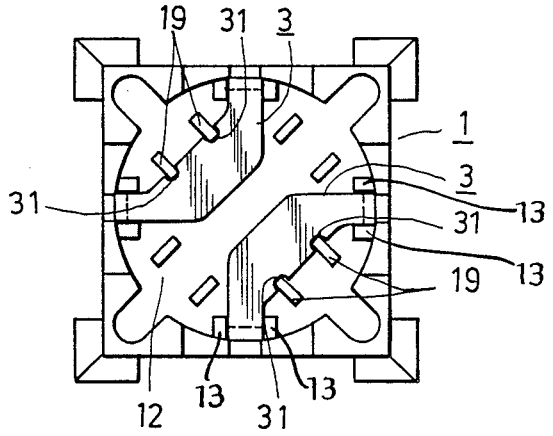
FIG. 6 is a top view showing the assembly of the base and the electrode elements of the keyswitch according to this invention.

In assembly, the electrode elements 3 are placed into the base 1 while permitting the legs 32 to slide downward along the guideways 14 and in turn to extend through the holes 15 of the base 1. As shown in FIG. 6, the horizontal ribs 19 of the base 1 are then engaged with the small notches 31 of the electrode elements 3 so as to position accurately the electrode elements 3 on the base 1. The spring 4 is also placed into the base 1. Because the vertical ribs 13 have tapered upper ends, the spring 4 can be guided by the vertical ribs 13 to rest on the horizontal ribs 19, as shown in FIG. 8. The blocks 52 of the actuator 5 are engaged with the guide slots 17 of the base 1 and are depressed to slide downward until the actuator 5 engages the uppermost turned portion of the spring 4 with the lower end annular groove 53. The cover 2 is placed on the base 1 in such a manner that the suspending rods 24 extend into the guideways 14. Finally, the cover 2 is depressed to engage the notches 16 of the base 1 with the positioning sheets 25 while permitting the protrusions 18 of the base 1 to engage with the engagement holes 21 of the cover 2. Depressing the cover 2 also causes the upper end of the actuator 5 to extend upward out of the central passage 23. It can be appreciated that it is easy to assemble the parts of the keyswitch together since the keyswitch has a symmetrical structure. Furthermore, because it is easy to position all of the parts in the keyswitch, the number of poor-quality or defective products produced during the manufacturing process can be largely reduced.

In use, the legs 32 of the electrode elements 3 are electrically connected to an electric circuit. For example, the legs 32 may be mounted on an electric circuit in the keyboard of a computer in such a manner that a key top 60, (see FIGS. 8 and 8A), is mounted on the actuator 5. Referring to FIG. 8, the spring 4 is normally located above the electrode elements 3. As shown in FIG. 8A, when the key top 60 is depressed, the second turned portion 4B from the bottom of the spring 4 moves downward through the lowermost turned portion 4A of the spring 4 so as to come into bridging contact with the electrode elements 3 and establish a conductive path between the electrode elements 3 due to the fact that the spring 4 is made of a conductive material.

Referring to FIGS. 9 and 9A, the way in which the lowermost turned portion of the spring is insulated from the electrode elements may be changed. As illustrated, the horizontal ribs 19 are not provided on the bottom wall of the base. The lowermost turned portion 4B' of the spring 4' rests on the electrode elements 3' and is coated with an insulative material 61 so that the spring 4' is normally insulated from the electrode elements 3'. When the key top is depressed, the upper portion of the spring 3' moves downward with said key top through the lowermost turned portion of the spring 4' so as come into bridging contact with the electrode elements 3'.

Because the turned portions of the spring of all embodiments of this invention have different diameters, when the actuator 5 is depressed, it is easy for the operator to sense the position of the actuator 5 relative to the base 1.

Referring to FIG. 10, the electrode elements 3' may be replaced by a first U-shaped electrode element **3*a* and a second U-shaped electrode element 3*b* crossing the first element 3*a*. Each of the elements 3*a*, 3*b* has a horizontal body disposed on the bottom wall of the base, and two legs inserted through the holes of said bottom wall. The first element 3*a* is located above the second element 3*b* and has a curved portion 3*c* at the middle of the horizontal body positioned over the second element 3*b* so that the elements 3*a*, 3*b*** are normally spaced apart.

The spring may be designed so that several turned portions thereof can be brought into bridging contact with the electrode elements when the actuator is depressed. In a case where the keyswitch is used in a keyboard, it is desirable that the spring and the electrode elements have a small interengaging area and are made of low-resistivity conductive materials so as to achieve a perfect switching operation. When the spring and the electrode elements have a large interengaging area and are made of high-resistivity conductive materials, the keyswitch of this invention can be converted into a touch sensor. In this case, the greater the depressing force applied to the actuator, the more the turned portions of the spring engaged with the electrode elements. As a result of the touch sensor, when the actuator is depressed, the resistance of the touch sensor is reduced gradually.

Referring to FIG. 11, the keyswitch of this invention is utilized on a printed circuit plate 70 which includes a substrate 71, a conductive layer 72, a plurality of switching contacts 73, a common circuit 74, a plurality of separate circuits 75, and an insulative layer applied to the entire upper surface of the conductive layer 72 except for ten circular areas 76 of a diameter (d1) each area covering a portion of the common circuit 74 and the terminal of one separate circuit 75. A spring 4'' is similar to the spring 4 of the first embodiment in construction and has a lowermost turned portion which has a diameter (d2) greater than the diameter (d1) of the circular area 76. The spring 4'' is retained on the printed circuit plate 70 by a housing or base, (not shown), in such a manner that the lowermost turned portion of the spring 4'' is outside of the corresponding circular area 76. The housing is shaped in the form of a rectangular tube which has an open top side, an open bottom side and four integrally formed side walls. When the spring 4'' is depressed by striking a push-button type actuator (not shown) the upper portion of the spring 4'' moves into bridging contact with the common circuit 74 and the separate circuit 75 so as to establish a conductive path therebetween. The keyswitch of this embodiment is similar to that of the keyswitch of FIG. 9 in construction except that the bottom wall of the base and the electrode elements are not provided. In this embodiment, the electrode elements are replaced with the common circuit 74 and one separate circuit 75.

With this invention thus explained, it is apparent that numerous modifications and variations can be made without departing from the scope and spirit of this invention. It is therefore intended that this invention be limited only as indicated in the appended claims.

I claim:

1. A keyswitch comprising:

a hollow insulative base having an open top side, a bottom wall and four integrally formed side walls extending upward from a periphery of said bottom wall and four circumferentially equidistant vertical guide slots formed in inner surfaces of said side walls, each of said guide slots being disposed between adjacent two of said side walls, each of said side walls including two vertical ribs extending from an inner surface thereof to define a guideway therebetween, said bottom wall including four holes formed therethrough in alignment with said guideways, and a plurality of horizontal ribs extending from an upper surface of said bottom wall;

a pair of spaced-apart electrode elements each having a body placed on said bottom wall of said base, and two legs extending downward from said body to pass through an adjacent two of said holes;

a conductive coil spring, shaped in the form of a truncated cone with turns of different diameters which gradually decrease in size from bottom to top thereof, disposed in said base in such a manner that a lowermost turned portion of said spring is supported on said horizontal ribs and spaced from said electrode elements;

an insulative cover sealing said open side of said base and having a passage formed through said cover; and a depressible, insulative push-button type actuator including four connecting rods extending radially and outwardly from a peripheral surface of a lower end portion thereof, and four sliding blocks respectively secured to outer ends of said connecting rods and slidable in said guide slots of said base;

whereby, when said actuator is depressed to compress said spring, a turned portion of an upper portion of said spring moves through said lowermost turned portion so as to come into bridging contact with said electrode elements and establish a conductive path between said electrode elements.

2. A keyswitch as claimed in claim 1, wherein said cover includes a top wall and four spaced-apart resilient side walls extending downward from a periphery of said top wall, each of said side walls of said cover being inverted T-shaped so that any pair of adjacent said inverted T-shaped side walls define an engagement hole therebetween, said base including four engagement protrusions extending from outer surfaces of said side walls thereof so as to engage said engagement holes respectively, thereby retaining said cover on said base.

3. A keyswitch as claimed in claim 2, wherein said base has four notches formed in upper end portions of said side walls in alignment with said guideways, said cover including four suspending rods respectively extending downward from four side portions of said top wall so as to depress said electrode elements, and four positioning sheets each connecting one of said suspending rods to adjacent said inverted T-shaped side walls, lower ends of said suspending rods being positioned below those of said inverted T-shaped side walls and lower ends of said positioning sheets being positioned above those of said inverted T-shaped side walls so as to engage said notches of said base with said sheets, thereby positioning said cover on said base.

4. A keyswitch as claimed in claim 1, wherein each of said electrode elements is inverted U-shaped and has a horizontal portion and two vertical portions, said horizontal portions of said electrode elements crossing each other, one of said horizontal portions having a curved portion extending over the other of said horizontal portions.

5. A keyswitch as claimed in claim 1, wherein said coil spring and said electrode elements are made of low-resistivity conductive materials and have a small interengaging are between said coil spring and said electrode elements so as to achieve a perfect switching operation.

6. A keyswitch as claimed in claim 1, wherein said coil spring and said electrode elements are made of high-resistivity conductive materials and have a large interengaging area between said coil spring and said electrode elements so as to obtain a touch-sensitive effect.

7. A keyswitch comprising:

a hollow insulative base having an open top side, a bottom wall and four integrally formed side walls extending upward from a periphery of said bottom wall and four circumferentially equidistant vertical guide slots formed in inner surfaces of said side walls, each of said guide slots being disposed between an adjacent two of said side walls, each of said side walls including two vertical ribs extending from an inner surface thereof to define a guideway therebetween, said bottom wall including four holes formed therethrough in alignment with said guideways;

a pair of spaced-apart electrode elements each having a body placed on said bottom wall of said base, and two legs extending downward from said body to pass through an adjacent two of said holes;

a conductive coil spring, shaped in the form of a truncated cone with turns of different diameters which gradually decrease in size from bottom to top thereof, disposed in said base in such a manner that a lowermost turned portion of said spring is supported on said electrode elements, including an insulative material coated on said lowermost turned portion thereof;

an insulative cover sealing said open side of said base and having a passage formed through said cover; and a depressible, insulative push-button type actuator including four connecting rods extending radially and outwardly from a peripheral surface of a lower end portion thereof, and four sliding blocks respectively secured to outer ends of said connecting rods and slidable in said guide slots of said base;

whereby, when said actuator is depressed to compress said spring, a turned portion of an upper portion of said spring moves through said lowermost turned portion so as to come into bridging contact with said electrode elements and establish a conductive path between said electrode elements.

* * * * *